United States Patent [19]

Hannen

[11] Patent Number: 4,562,689

[45] Date of Patent: Jan. 7, 1986

[54] METHOD OF AND APPARATUS FOR SHRINKING AN ENVELOPE AROUND A STACK OF GOODS

[75] Inventor: Reiner W. Hannen, Goch, Fed. Rep. of Germany

[73] Assignee: MSK -Verpackungs-Systeme Gesellschaft Mit Beschrankter Haftung, Kleve, Fed. Rep. of Germany

[21] Appl. No.: 566,330

[22] Filed: Dec. 28, 1983

[30] Foreign Application Priority Data

Dec. 30, 1982 [DE] Fed. Rep. of Germany ... 8236854[U]

[51] Int. Cl.[4] ..... B65B 31/00; B65B 11/58; B65B 53/06

[52] U.S. Cl. ..... 53/434; 53/442; 53/449; 53/512; 53/557; 53/170

[58] Field of Search ..... 53/442, 434, 449, 557, 53/170, 512

[56] References Cited

U.S. PATENT DOCUMENTS

| | | | |
|---|---|---|---|
| 3,522,688 | 8/1970 | Kaliwoda | 53/442 |
| 3,717,939 | 2/1973 | Mitchell | 53/557 X |
| 3,826,017 | 7/1974 | Kostur | 53/557 X |
| 4,132,048 | 1/1979 | Day | 53/434 |
| 4,164,111 | 8/1979 | DiBernardo | 53/442 X |
| 4,314,141 | 2/1982 | Vangsted | 53/557 X |
| 4,471,599 | 9/1984 | Mugnai | 53/434 |

FOREIGN PATENT DOCUMENTS

| | | | |
|---|---|---|---|
| 2944321 | 5/1981 | Fed. Rep. of Germany | 53/442 |

*Primary Examiner*—John Sipos

*Attorney, Agent, or Firm*—Karl F. Ross; Herbert Dubno

[57] ABSTRACT

In order to package a stack of goods in an envelope of heat-shrinkable plastic material such as polyethylene, with prevention of adhesion between the envelope and the goods which may themselves be wrapped in similar sheet material, the stack is placed on a pallet and is covered by the envelope whose lower rim is clamped between the legs of the pallet and an apertured supporting surface such as an upper run of a chain conveyor. The envelope is then inflated from below, by way of the supporting surface, with a low-temperature gas such as ambient air, to establish significant clearances between the stack and the inner surface of the envelope which is then thermally shrunk around the stack by training jets of hot gas onto its outer surface. In zones where the envelope is in contact with the stack, as along edges of the latter, the heating intensity may be reduced to avoid fusion with individual wrappings.

8 Claims, 1 Drawing Figure

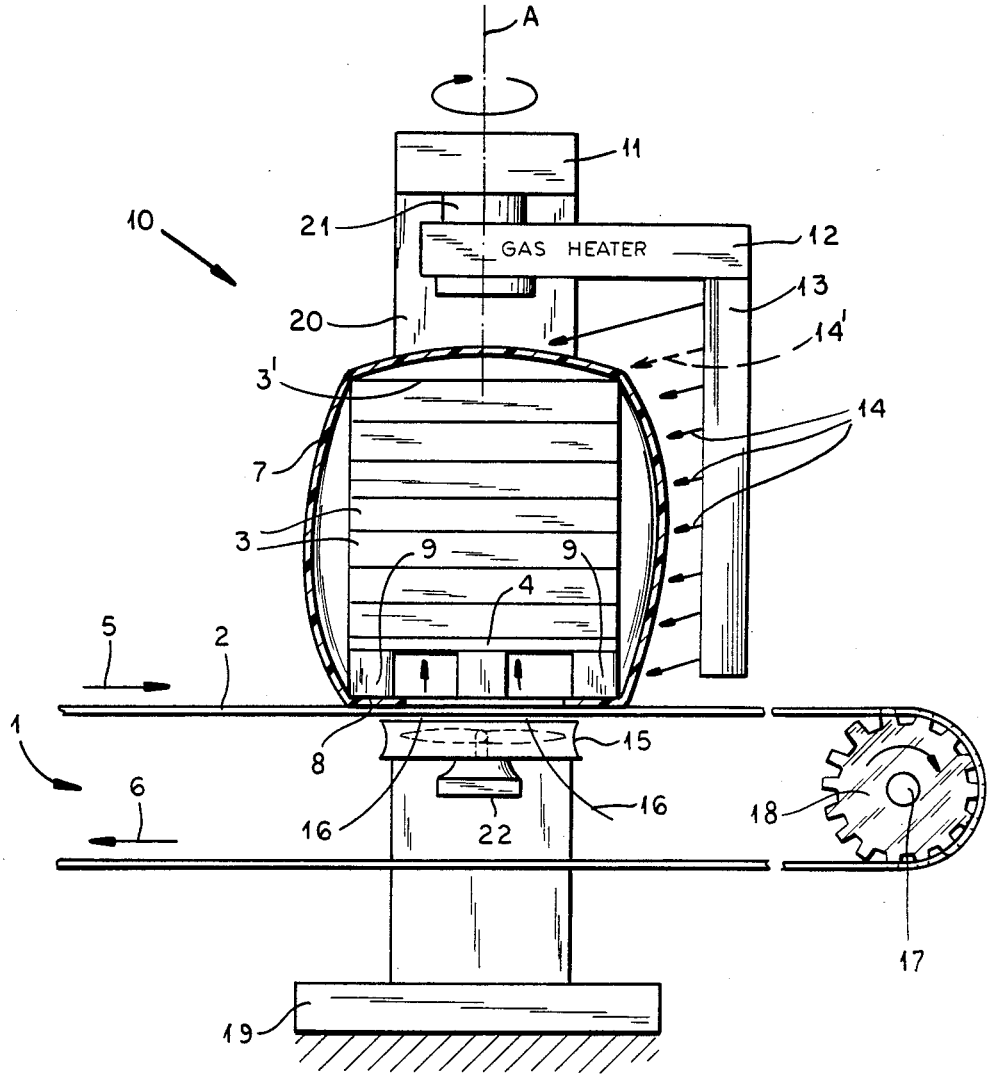
A
11
10
21
GAS HEATER
12
13
20
14'
3'
14
7
3
9
9
4
5
2
1
8
15
6
16
16
22
18
17
19

METHOD OF AND APPARATUS FOR SHRINKING AN ENVELOPE AROUND A STACK OF GOODS

FIELD OF THE INVENTION

My present invention relates to a method of packaging a stack of goods and to an apparatus for carrying out this method.

BACKGROUND OF THE INVENTION

In order to maintain the integrity of a stack of boxes or other more or less similar goods during transportation and handling, it is convenient to enshroud the stack in an envelope of thermally shrinkable plastic sheet material—usually polyethylene—which is then subjected to a heat treatment in order to form a substantially solid package. When the stack is supported on a pallet, as is frequently the case, the envelope may be a hood held down around the stack and the pallet so as to embrace the latter with its contracting rim.

Boxes and other stackable goods, e.g. bottles placed between sheets of cardboard, are often provided with individual wrappings of thermoplastic foils having a tendency to adhere to the surrounding envelope during the shrinking process. Such a fusion creates difficulties when the goods are to be unstacked and removed from the pallet.

Various solutions to this problem have already been proposed. One of them involves the use of polyvinylchloride (PVC) for the individual wrappings, yet this material is relatively expensive. The use of heavier wrappings of, say, polyethylene (PE) to prevent them from tearing because of local adhesions is also costly. Separating the shrinkable envelope from the goods by a sheath of nonadhering foil requires an additional operating step, namely that of placing the sheath around the stack. This step can be avoided through the use of multilayer envelopes with an outer layer of PE and an inner layer of nonbonding character. However, such envelopes are more costly to produce and their adhesion-preventing inner layer—having a higher melting point than PE—contracts less readily and thus retards the shrinking process.

OBJECTS OF THE INVENTION

An important object of my present invention, therefore, is to provide a method of thermally shrinking an envelope of thermoplastic sheet material around a stack of items with individual wrappings of similar sheet material prone to fuse onto the envelope during the shrinking process, as where both sheet materials consist of PE.

A related object is to provide an apparatus facilitating the shrinking of envelopes by this method about a stack and a pallet supporting same.

SUMMARY OF THE INVENTION

In accordance with my present invention, the placing of an envelope of thermally shrinkable plastic sheet material around a stack to be packaged is followed by the introduction of a sustaining gas of substantially ambient temperature, preferably ambient air, into the envelope for inflating same to create significant clearances between the stack and the inner surface of the envelope. The envelope so inflated is then heated from the outside to a temperature sufficient to shrink same against the inflating pressure of the sustaining gas which, of course, must be held well below the contractile stresses of that envelope. When the heat treatment is completed, the gas pressure is released whereby the last phase of the shrinking process takes place under elastic contraction—possibly assisted by suction—and thus at relatively low temperatures avoiding the risk of adhesion between the envelope and the individual wrappings.

Advantageously, especially when the stack is carried on a pallet, the envelope is a downwardly open hood whose rim is clamped at a treatment station between an apertured supporting surface and the stack (directly or through the intermediary of the pallet) so that air can be blown in from below by way of that surface. More particularly, the supporting surface may be part of a transporter designed to move the stack on its pallet into and out of the treatment station, e.g. the upper run of an endless conveyor chain.

Some contact between the envelope and the stack will usually be unavoidable, especially at the edges of the uppermost item. In order to obviate the risk of adhesion at such a zone of contact, I prefer to reduce the intensity of the heat treatment at that zone during the shrinking process. This can be conveniently achieved by the use of a multiplicity of jets of hot gas trained onto the outer surface of the envelope, with reduction of the flow rate and/or the temperature of any jet directed onto such a zone of contact.

BRIEF DESCRIPTION OF THE DRAWING

The above and other features of my invention will now be described in detail with reference to the accompanying drawing the sole FIGURE of which illustrates, somewhat diagrammatically, an apparatus for packaging a stack of goods in accordance with this invention.

SPECIFIC DESCRIPTION

In the drawing I have shown part of a chain-type conveyor 1 led about a sprocket 18, an upper run of this conveyor forming a supporting surface 2 on which a pallet 4 carrying a stack of goods 3 is transported from a nonillustrated loading station to a treatment station 10. The sense of motion of the upper and lower runs of conveyor 1 has been indicated by arrows 5 and 6. Pallet 4 has at least three legs 9 by which it rests on conveyor surface 2, these legs holding down the rim 8 of a hood 7 of PE enveloping the stack and the pallet. With the conveyor arrested in the treatment station 10, the open end of hood 7 comes to lie above a blower 15 driving ambient air into its interior to inflate same. The inflating air flow, indicated by arrows 16, passes between the pallet legs 9 so as to maintain the hood 7 spaced from the goods 3 except at the corners of the top surface 3' of the uppermost item of the stack; these items may be square or otherwise polygonal boxes, for example, with individual wrappings also consisting of PE.

A base 19 at station 10 carries an upright or mast 20, well spaced from the conveyor 1, which suuports an arm 11 overhanging the conveyor. A shaft 21 depending from arm 11 is centered on an axis A which passes centrally through the stack of goods 3 and is also the axis of blower 15 supported by another arm 22 on upright 20. Shaft 21, driven by a nonillustrated motor, carries a rotatable heating device with a horizontal arm 12 and a vertical arm 13 which form conduits for a flow of heating gas supplied from a nonillustrated source through the shaft 21. Vertical arm 13 is provided with a column of nozzles emitting jets of hot gas toward axis A and thus onto the outer surface of hood 7 as indicated by arrows 14. These jets are individually heated; thus, they may be formed from combustion gases emitted by respective burners. One such jet, trained upon the contact zone at the level of top surface 3', is less intense than the others as indicated by a dashed arrow 14'. In this contact zone, therefore, the hood 7 is only moderately heated to avoid fusion with the wrapping material as the device 12, 13 is rotated completely about axis A and thus about the enveloped stack. When the hood 7 has shrunk sufficiently, heating is discontinued and blower 15 may be reversed for exhausting air from the interior of the hood in order to accelerate its final contraction. Thus, blower 15 may be a reversible version of an exhauster conventionally provided at a heat-shrinking station; alternatively, I may use separate blowers for inflating and deflating the hood.

It should be noted that the air blown in to inflate the hood also has a cooling effect which further reduces the risk of adhesion between the hood and the wrappings of the goods. This is especially true since, in practice, some air will continuously escape from the interior of the hood during its inflation whereby a continuous circulation is maintained by the blower.

I claim:

1. A method of packaging, in an outer covering of thermally shrinkable plastic material, a stack of goods at least one of which is enclosed in an inner covering material capable of being bonded to said plastic material of said outer covering, comprising the steps of:

(a) placing said stack of goods on an apertured supporting surface;

(b) placing a hood of said thermally shrinkable plastic material, which hood is closed at one of its ends and open at the other of its ends, open end down over and around said stack of goods, and turning the edge region of said hood which bounds its said open end peripherally in under said stack of goods so as to clamp said edge region between said stack of goods and said supporting surface;

(c) introducing air at substantially ambient temperature into said hood from below through said supporting surface to inflate said hood and create significant clearances between the inner surface of said hood and said inner covering material of said goods in said stack;

(d) heating said hood from the outside to a temperature sufficient to generate shrinkage stresses in said thermally shrinkable plastic material and thereby to cause said hood to shrink against the air inflation pressure therein;

(e) during the heating step controlling the intensity of the heat applied to said hood so as to be less in any zone where contact exists between the inner surface of the inflated hood and said inner covering material of said goods in said stack than in any zone where no such contact exists, thereby to minimize the risk of said hood becoming bonded to said inner covering material of said goods in any such contact zone; and (f) releasing the inflation pressure from the interior of said hood after an initial degree of shrinking of said hood to permit completion of the shrinking of said hood into closely confining relation to said stack of goods.

2. A method as defined in claim 1 wherein said stack of goods is carried on a pallet having legs resting on said supporting surface, and said air is passed between the pallet legs into the interior of said hood.

3. A method as defined in claim 1 wherein said supporting surface is formed by an upper run of a conveyor chain chain by which said stack of goods is transported into a heating station.

4. A method as defined in claim 1 wherein said heating step is performed by training jets of hot gas onto the outer surface of said hood.

5. An apparatus for packaging, in an outer covering of thermally shrinkable plastic material, a stack of goods at least one of which is enclosed in an inner covering material capable of being bonded to said plastic material of said outer covering, comprising:

(a) transport means provided with a apertured supporting surface for carrying said stack of goods, enveloped by a hood of said thermally shrinkable plastic material fitted open end down over said stack, to a treatment station;

(b) blower means at said treatment station disposed beneath said supporting surface for directing a stream of air at substantially ambient temperature from below through said supporting surface into said hood to inflate the latter and create significant clearances between the inner surface of said hood and said inner covering material of said goods in said stack;

(c) heating means at said treatment station adapted to be juxtaposed to the outer surface of said hood for applying heat thereto and raising the temperature of said hood to a level sufficient to generate shrinkage stresses in said thermally shrinkable plastic material and thereby to cause said hood to shrink against the air inflation pressure therein;

(d) said heating means including means for controlling the intensity of the heat applied to said hood so as to be less in any zone where contact exists between the inner surface of the inflated hood and said inner covering material of said goods in said stack than in any zone where no such contact exists, thereby to minimize the risk of said hood becoming bonded to said inner covering of said goods in any such contact zone; and (e) means for releasing the inflation pressure from the interior of said hood after an initial degree of shrinking of said hood to permit completion of the shrinking of said hood into closely confining relation to said stack of goods.

6. An apparatus as defined in claim 5 wherein said heating means comprises a plurality of emitters of jets of hot gas trained upon said hood.

7. An apparatus as defined in claim 5 wherein said transport means comprises an upper run of a conveyor chain.

8. An apparatus as defined in claim 5 wherein said blower means comprises a reversible exhauster.

* * * * *